US005801611A

United States Patent [19]

Van Loenen et al.

[11] Patent Number: 5,801,611

[45] Date of Patent: Sep. 1, 1998

[54] INDUCTIVE DEVICE

[75] Inventors: Evert J. Van Loenen; Jan W. Waanders, both of Eindhoven, Netherlands

[73] Assignee: U.S. Philips Corporation, New York, N.Y.

[21] Appl. No.: 713,310

[22] Filed: Sep. 13, 1996

[30] Foreign Application Priority Data

Sep. 14, 1995 [EP] European Pat. Off. ..... 95202489

[51] Int. Cl.[6] ..... H01F 27/02; H01F 5/00; H01F 27/28

[52] U.S. Cl. ..... 336/200; 336/232; 336/223; 336/83

[58] Field of Search ..... 336/200, 223, 336/232, 83

[56] References Cited

U.S. PATENT DOCUMENTS

| | | | |
|---|---|---|---|
| 2,014,524 | 9/1935 | Franz | 336/200 |
| 3,484,731 | 12/1969 | Rich, III | 336/182 |
| 5,084,958 | 2/1992 | Yerman et al. | 336/223 |

FOREIGN PATENT DOCUMENTS

| | | | |
|---|---|---|---|
| 0506362A2 | 9/1992 | European Pat. Off. | 336/200 |
| 1185354 | 7/1956 | France | 336/200 |
| 62-104013A | 5/1987 | Japan | 336/200 |
| 5-90031A | 4/1993 | Japan | 336/200 |
| 5166640A | 7/1993 | Japan | 336/200 |
| 5-275254 | 10/1993 | Japan | 336/232 |

*Primary Examiner*—Michael L. Gellner
*Assistant Examiner*—Anh Mai
*Attorney, Agent, or Firm*—Edward Blocker

[57] ABSTRACT

The device comprises an electrically insulating substrate comprising a principal section (3). First and second principal surfaces (*1a*, *1b*) of the principal section (3) support first and second pairs of conductor tracks, respectively. Each pattern comprises a series of coil elements (7), opposite each coil element of the first pattern there being situated a coil element of the second pattern. Each coil element (7) comprises a spiral-shaped conductor track, having an inner end (9) and an outer end (11), and some coil elements are electrically interconnected in a two-by-two fashion by means of a connection track (13) which extends between their outer ends, the connection tracks on each of the two principal surfaces extending opposite parts of the other principal surface which are free from connection tracks. The principal section (3) is folded, so that the coil elements are situated in mutually parallel planes. The spirals of oppositely situated coil elements (7) of the first and the second pattern have the same winding direction and their inner ends (9) are electrically interconnected by means of interconnections (15) which extend between the first and second principal surfaces (*1a*, *1b*).

7 Claims, 3 Drawing Sheets

INDUCTIVE DEVICE

Figure 1A:
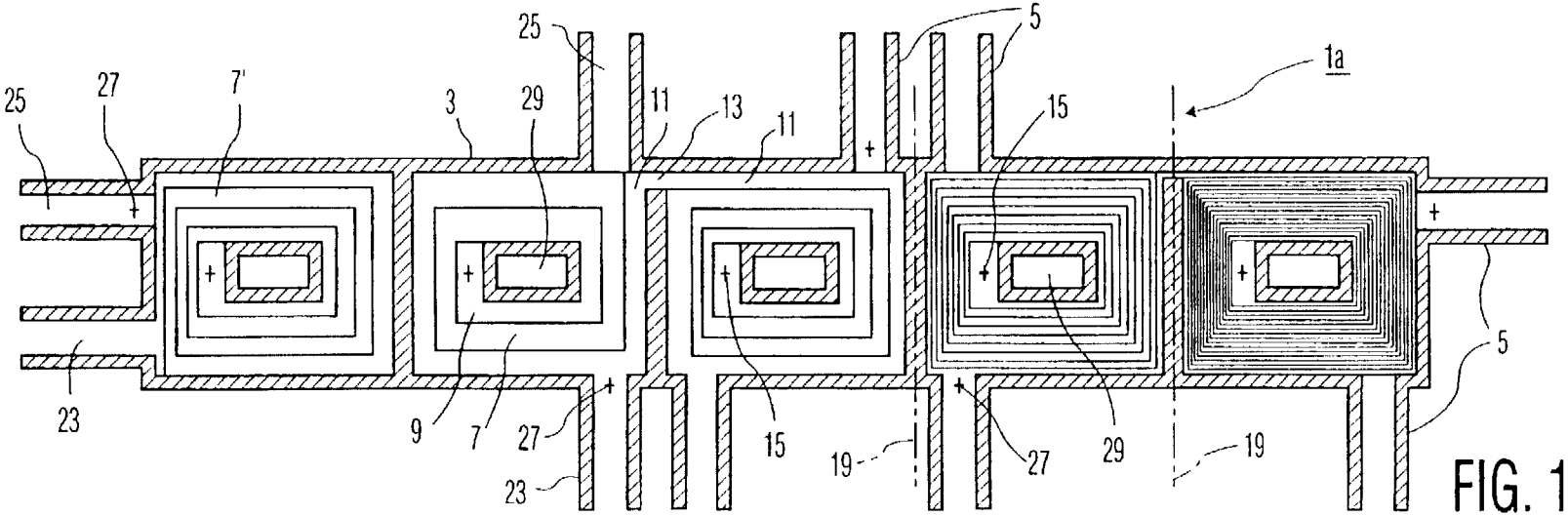

The invention relates to an inductive device, comprising a substrate in the form of a foil of an electrically insulating material having a principal section and first and second principal surfaces, on the first and second principal surfaces of the principal section there being provided first and second patterns of conductor tracks, respectively, each pattern comprising a series of coil elements in such a manner that opposite each coil element of the first pattern there is situated a coil element of the second pattern, each of said coil elements comprising a conductor track which extends spirally between an inner end and an outer end, at least some of the coil elements being electrically interconnected in a two-by-two fashion by means of a connection track which extends between the outer ends of the spirals, the connection tracks on each of the two principal surfaces extending opposite parts of the other principal surface which are free from connection tracks, said principal section being folded along folding lines which extend between every two successive coil elements in such a manner that the coil elements are situated in mutually parallel planes.

A device of this kind is known from U.S. Pat. No. 3,484,731. The coil elements on one of the principal surfaces of the known device together constitute a coil comprising a predetermined number of turns. To this end, the inner ends of the spiral-shaped conductor tracks of successive coil elements which are not interconnected via a connection track are electrically interconnected, after folding, by welding or soldering. The interconnection of each pair of inner ends then requires a separate operation. For the formation of a transformer a second coil is formed in the same way on the other principal surface, said second coil being inductively coupled to the first coil. A first drawback of the known device consists in that making the connections between the inner ends of the spiral-shaped conductor tracks is time-consuming and expensive. A second drawback consists in that two layers of the substrate material are always present between two coil elements interconnected by a connection track. As a result, the space factor (the percentage of the total volume of the coil which consists of electrically conductive material) is comparatively small. Consequently, the dimensions of the device are usually larger than desirable and, when the device is a transformer, the coupling factor between the primary and secondary windings is smaller than desirable.

It is an object of the invention to provide a device of the kind set forth whose manufacture is comparatively fast and inexpensive and which comprises coils having a comparatively high space factor. To this end, the device in accordance with the invention is characterized in that the spirals along which the conductor tracks of oppositely situated coil elements of the first and the second pattern extend have the same winding direction and that the inner ends of the spiral-shaped conductor tracks of oppositely situated coil elements of the first and the second pattern are electrically interconnected by means of interconnections which extend between the first and second principal surfaces. The winding direction of a spiral-shaped conductor is defined by looking down onto the surface on which the conductor is provided. All necessary interconnections can be simultaneously realised, for example by electrolytic metallization of holes provided in the principal section of the substrate. This process may be combined, if desired, with the increasing of the thickness of the conductor tracks by electrolytic deposition. The formation of the interconnections, therefore, is a very inexpensive and fast process. Because a coil is composed of coil elements situated on both sides of the substrate, for a coil comprising a given number of coil elements the number of layers of substrate material amounts to only half the number in the known device. This represents a substantial improvement of the space factor.

An embodiment of the device in accordance with the invention can be constructed to comprise a number of electrically isolated coils. Such an embodiment is characterized in that the first and the second pattern comprise at least two successive coil elements which are electrically isolated from one another and which also occupy corresponding positions in the relevant pattern. The various coils of the device are magnetically coupled to one another so that this embodiment is very suitable for use as a transformer.

An improved embodiment of the device in accordance with the invention is characterized in that the substrate comprises a number of lead-outs which extend outside the principal section, on at least one of the principal surfaces of each lead-out there being provided a first further conductor track which is electrically connected to one of the spiral-shaped conductor tracks on the relevant principal surface. The lead-outs have two useful functions. First of all, the further conductor tracks provided on the lead-outs constitute an electric connection between the various conductor tracks present on the substrate. As a result, the thickness of these conductor tracks can be increased electrolytic deposition, resulting in a further increase of the space factor. A large substrate can thus be provided with conductor tracks in one manufacturing step, the substrate subsequently being used to form a large number of inductive devices. To this end, after the electrolytic operations the substrate is divided into sub-substrates by cutting the intermediate lead-outs. Secondly, the lead-outs provided with the further connection tracks may serve as electrical connections, so that an inductive device comprising a number of branches can be readily manufactured at no additional cost. In order to form this connection on an arbitrary principal surface, a preferred embodiment is characterized in that on the oppositely situated principal surface of at least some of the lead-outs there is provided a second further conductor track which is electrically connected, by means of a further interconnection which extends between the first and the second principal surface, to the first further conductor track of the relevant lead-out.

A further preferred embodiment of the device in accordance with the invention is characterized in that each spiral-shaped conductor track extends around a central opening which is formed in the principal section and is situated near the inner end of the relevant conductor track, all central openings in the folded principal section together constituting a passage, the device furthermore comprising a core of a soft-magnetic material which comprises a limb which extends through the passage. The inclusion of a core of a soft-magnetic material increases the inductance of the coils constituting the device. It is to be noted that an inductive device comprising a folded strip-shaped substrate with conductor cores and a core is known per se from FR-A-1 185 354. The known device, however, does not comprise successive pairs of coil elements which are interconnected two by two by a connection track extending between the outer ends of the spirals. The coil elements are interconnected via connection tracks on the other side of the substrate, so that coil elements cannot be readily provided on both sides of the substrate.

For the latter embodiment of the device in accordance with the invention ease of handling and very good magnetic shielding can be obtained by shaping the core as a substantially closed box which encloses the folded principal section.

A further embodiment of the device in accordance with the invention is characterized in that the substrate comprises a further substrate section which is connected to the principal section and which supports third further conductor tracks on which components of an electronic circuit are mounted and which are connected to at least two of the first further conductor tracks. This embodiment is particularly suitable for the manufacture of a circuit comprising a coil or a transformer, for example a switched power supply. Because the entire substrate can be manufactured during a single process step, its manufacture is very inexpensive. Because the inductive device and the remainder of the circuit utilize the same substrate, moreover, a very compact unit can be realised.

These and other aspects of the invention will be apparent from and elucidated with reference to the embodiments described hereinafter.

Figure 1B:
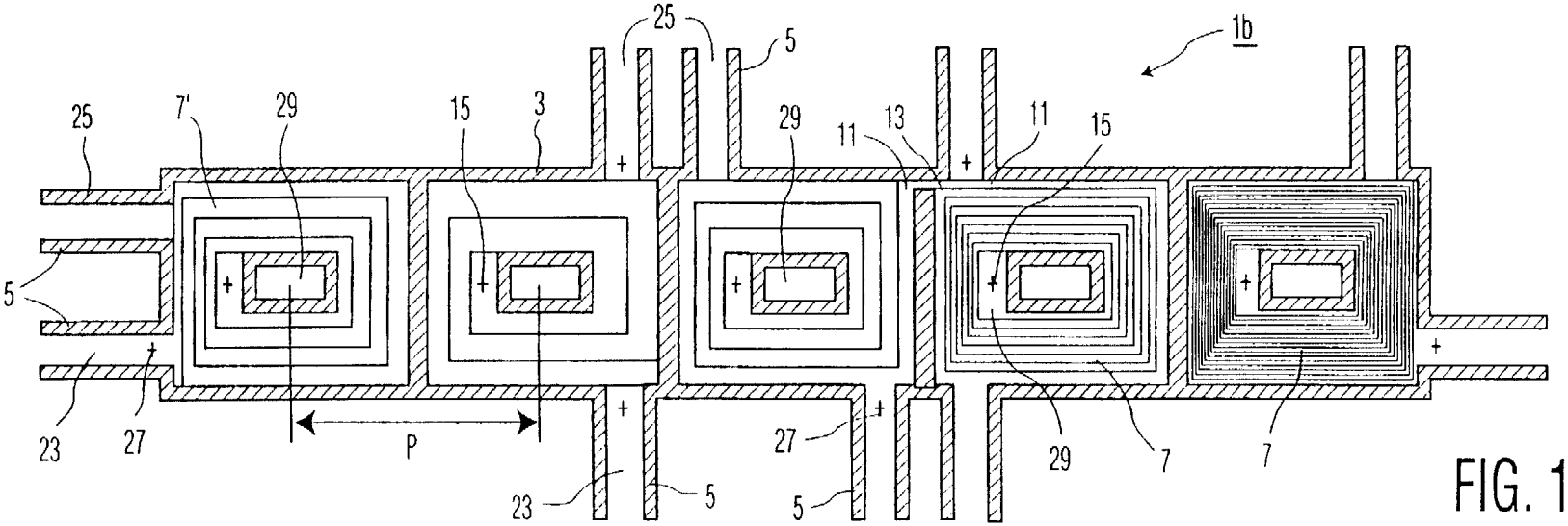
Figure 2:
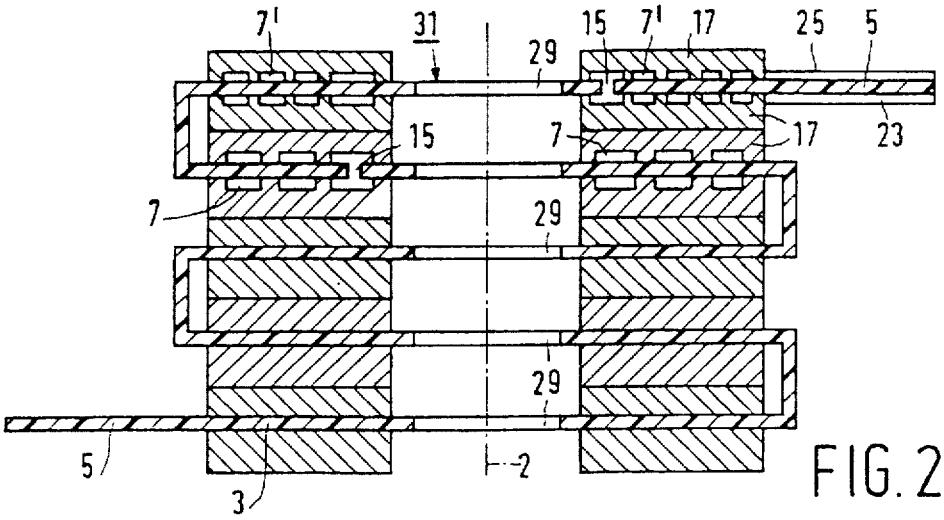
Figure 5:
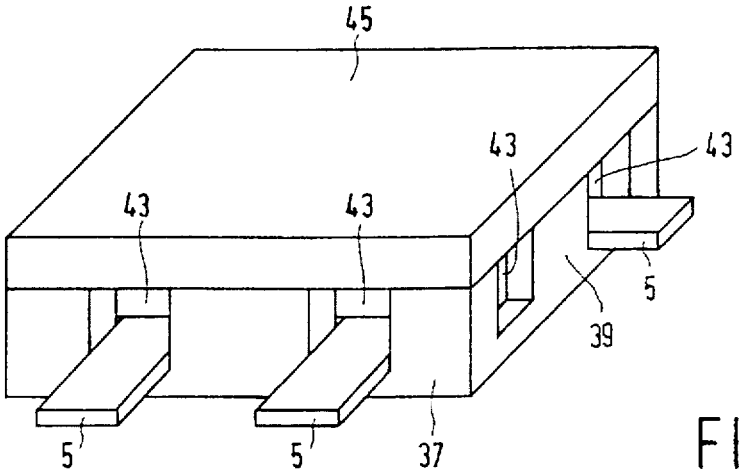
Figure 6:
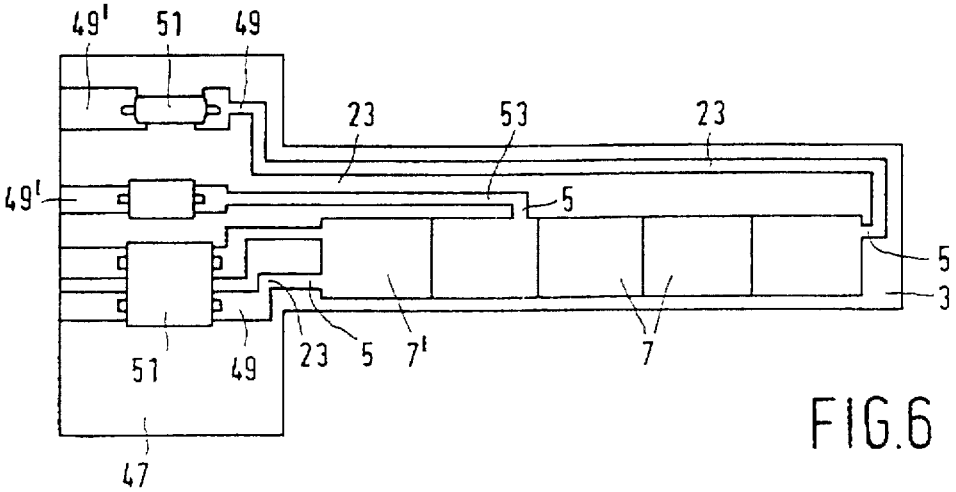
Figure 3:
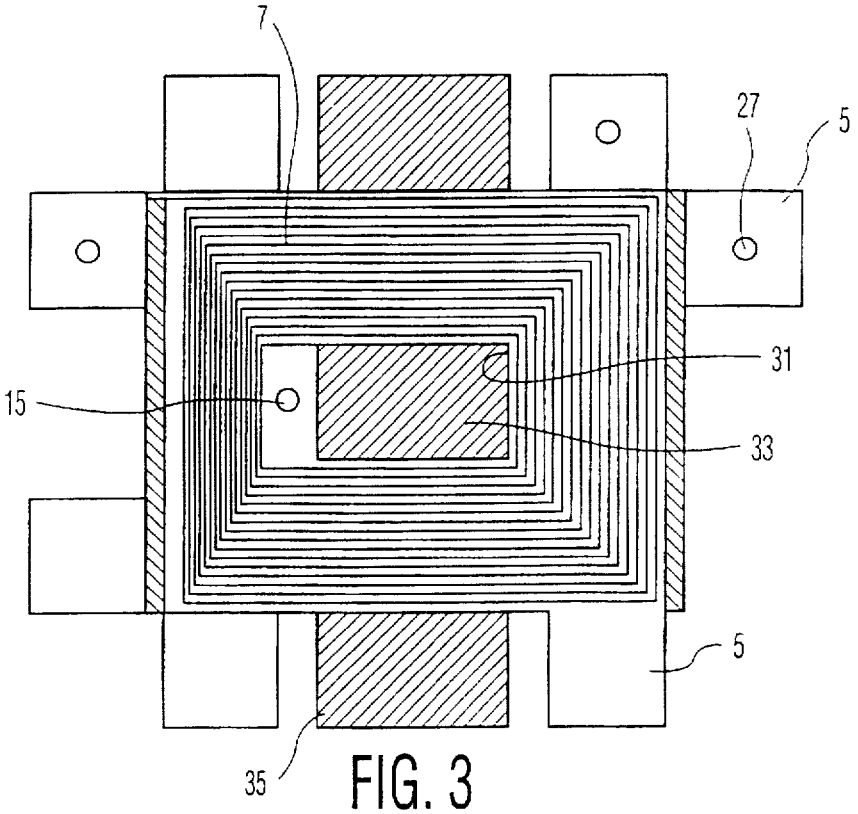
Figure 4:
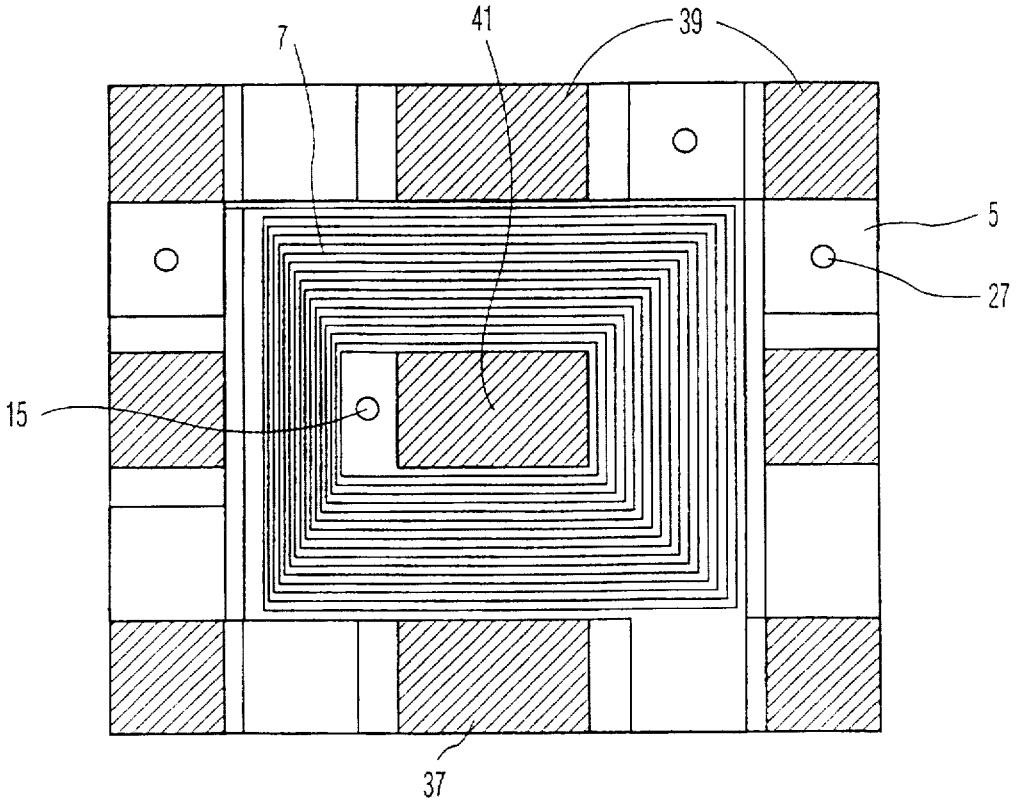

In the drawings:

FIG. 1A is a plan view of a first principal surface of a section of a substrate provided with an embodiment of a first conductor pattern, FIG. 1B is a plan view of a second principal surface of the substrate section shown in FIG. 1, comprising an associated second conductor pattern, FIG. 2 is a side elevation of the substrate of FIG. 1 in the folded condition, FIG. 3 is a cross-sectional view of an embodiment of an inductive device in accordance with the invention, comprising a core of a soft-magnetic material and a folded substrate as shown in FIG. 2, FIG. 4 is a cross-sectional view of a second embodiment of an inductive device in accordance with the invention, FIG. 5 is a perspective view of the device shown in FIG. 4, and FIG. 6 shows an embodiment of a substrate which comprises a further substrate section on which an electronic circuit is formed.

FIGS. 1A and 1B show a first principal surface 1*a* and a second principal surface 1*b*, respectively, of a part of a substrate in the form of a foil of an electrically insulating material, for example polyamide. The part of the substrate shown comprises a principal section 3 and a number of lead-outs 5 which extend outside the principal section. On each of the two principal surfaces 1*a* and 1*b* there is provided a pattern of conductor tracks which is formed in known manner, for example by selective etching of a copper layer provided on the substrate. In the FIGS. 1A and 1B the conductor tracks are shown in white and the parts of the substrate which are not covered by conductor tracks are shown in black. Each pattern comprises a series of coil elements 7 which succeed one another in the longitudinal direction of the principal section 3 which, in this embodiment, is strip-shaped. The patterns are designed so that opposite each coil element 7 of the first pattern (on the first principal surface 1*a*) there is situated a coil element of the second pattern (on the second principal surface 1*b*). Each coil element 7 comprises a spirally extending conductor track which has an inner end 9 and an outer end 11. In the embodiment shown here the coil elements 7 have a rectangular shape. Other shapes, such as oval or circular, are, of course, also feasible. Over a part of the length of the principal section 3 successive coil elements 7 are electrically interconnected two-by-two by means of a connection track 13 which extends between the outer ends 11 of the spiral-shaped conductor tracks, so that each pattern on the relevant section comprises one or more successive pairs of interconnected coil elements. Each pair of interconnected coil elements 7 is isolated from the neighbouring coil elements by a part of the relevant principal surface 1*a*, 1*b* which is free from connection tracks 13 and hence has an electrically insulating effect. The connection tracks 13 on each of the principal surfaces 1*a*, 1*b* extend opposite parts of the other principal surface which are free from connection tracks, so that the interconnected pairs of coil elements 7 on the first principal surface 1*a* are offset with respect to the corresponding pairs of coil elements on the second principal surface 1*b* over a distance equal to the pitch p of the pattern of coil elements. In the embodiment shown, two pairs of interconnected coil elements 7 are present on the first principal surface 1*a*; the second principal surface accommodates one pair which is flanked by two loose coil elements which do not form part of a pair. Thus, four coil elements 7 of each pattern are concerned which are situated at the right of the pattern in the FIGS. 1A and 1B. At the left-hand end of the pattern there is situated a single coil element 7' which does not form part of an interconnected pair in any pattern and whose purpose will be explained hereinafter.

The FIGS. 1A and 1B clearly show that the spirals along which the conductor tracks of the coil elements 7 extend all have the same winding direction in the example shown. The winding direction is defined by looking down onto the surface on which the relevant conductor track is situated, i.e. for the first pattern on the first principal surface 1*a* as shown in FIG. 1A and for the second pattern on the second principal surface 1*b* as shown in FIG. 1B. In the embodiment shown, the winding direction of all spirals, going from the inner end 9 to the outer end 11, is counter-clockwise. The inner ends of the spiral-shaped conductor tracks of oppositely situated coil elements of the first and the second pattern are electrically interconnected by means of interconnections 15 which extend between the first and second principal surfaces 1*a*, 1*b*. These interconnections are denoted by a + symbol in the FIGS. 1A and 1B. They can be formed, for example as follows: during the etching of the conductor patterns on the two principal surfaces 1*a*, 1*b*, an opening is formed in the metal layer in every location in the first or in the second pattern in which an interconnection 15 is to be situated. Subsequently, at the area of these openings the material of the substrate is locally removed, for example by means of a laser, a drill or a punch, so that at these areas an opening is formed in the substrate. Finally, the entire conductor pattern on the two principal surfaces 1*a*, 1*b* is electrolytically reinforced, the thickness of the conductor tracks then being increased, the distances between the conductor tracks being decreased and copper being deposited in the openings formed in the substrate. An interconnection 15 is thus formed at the area of each opening.

As a result of the interconnections 15, the conductor tracks of oppositely situated coil elements 7 of the first and the second pattern are electrically connected in series. An electric current input via an inner end 11 of a conductor track of a coil element 7 on the first principal surface 1*a* will then clock-wise encircle, looking from a point above the first principal surface, the centre of the coil element until it reaches the inner end 9. Subsequently, the current will reach, via the interconnection 15, the inner end of the conductor track of the oppositely situated coil element on the second principal surface 1*b* after which, still looking from the same point above the first principal surface 1*a*, it clock-wise encircles the centre of this coil element until it reaches its outer end 11. The current thus encircles, always in the same direction, an imaginary axis which extends through the centre of two oppositely situated coil elements 7, and the magnetic flux generated by this current in the two coil elements together, therefore, will be twice the flux generated in one coil element. The inductance of the two series-connected coil elements 7 amounts to four times the inductance of a single coil element (the number of turns is twice as large).

FIG. 2 is a sectional view of the result of some subsequent operations performed on the principal section 3 shown in the FIGS. 1A and 1B. After the formation of the interconnections 15, an electrically insulating layer 17 is provided on the two principal surfaces 1*a*, 1*b*, for example by application of a thin foil which is glued on both sides. The insulating layer 17 covers at least the coil elements 7, only four of which are shown in FIG. 2 for the sake of clarity. The principal section 3 is then folded along folding lines 19, some of which are denoted by dash-dot lines in FIG. 1A. The folding lines 19 extend, transversely of the longitudinal direction of the principal section 3, between every two successive coil elements 7. Each coil element 7 is then folded through an angle of 180° with respect to the neighbouring coil element, so that after the folding operation the coil elements are situated in mutually parallel planes and form a stack which can be formed into a compact unit by heating and pressing, if desired. The ratios of the dimensions are not to scale in FIG. 2. The dimensions in the vertical direction have been strongly exaggerated for the sake of clarity. The most attractive method of folding is the zigzag-shape shown in FIG. 2. However, other folding methods are in principle also feasible. The dimensions in the vertical direction can be reduced even further, if desired, by refraining from providing an insulating layer 17 on the entire principal surfaces 1*a*, 1*b*. For example, by alternately providing and not providing the coil elements on both sides of the substrate with an insulating layer 17, the overall insulation thickness can be halved.

After the folding of the principal section 3, the centres of all coil elements 7 are situated on a common axis 21. As has been demonstrated above, a current in two oppositely situated coil elements 7 of the first and the second pattern encircles this axis in the same direction. It will be evident that the current in a pair of coil elements 7 interconnected by a connection track 13, for example the second and the third coil element from the left in FIG. 1A, also encircles the axis 21 in the same direction. Assume that the current flows through the left-hand one of the two coil elements 7 under consideration from the inner end 9 to the outer end 11; it then encircles the centre of the coil element counter-clockwise, looking from a point above the plane of drawing. Via the connection track 13, the current then crosses to the outer end 11 of the right-hand coil element 7 and would encircle the centre of this coil element clockwise on its way to the inner end 9 if the principal section were not folded. However, because the right-hand coil element 7 has been folded through 180° with respect to the left-hand coil element as explained above, the current encircles the centres situated on the same axis 21 counter-clockwise, looking from said point. This demonstrates that the magnetic flux in all coil elements 7 will have the same direction after the folding of the embodiment shown. The inductance of the coil formed by the series-connected coil elements 7, therefore, is proportional to the square of the sum of the number of turns of all coil elements of the series connection. The first four coil elements 7 on the two principal surfaces 1*a* and 1*b* shown at the right in the FIGS. 1A and 1B thus together constitute a coil consisting of eight coil elements. In the present embodiment, viewed from left to right, these coil elements comprise successively two, four, eight and sixteen turns. Thus, the entire coil comprises 2*(2+4+8+16)=60 turns. Evidently, it is also possible to choose other distributions of the turns between the coil elements, for example the same number of turns per coil element.

The two patterns on the first and second principal surfaces 1*a* and 1*b* comprise, at the extreme left-hand side in the FIGS. 1A and 1B., two successive coil elements 7 and 7' which are electrically isolated from one another and which also occupy corresponding positions in the relevant pattern. Consequently, in both patterns the first coil element 7' from the left is electrically isolated from the above coil comprising 60 turns and formed by the remaining two times four coil elements 7. Thus, the coil elements 7' together constitute a second coil which comprises two times four turns in the present embodiment. Evidently, it would also be feasible to continue the principal section of the substrate further to the left and to provide, to the left of the coil elements 7', even more coil elements which, if desired, could be connected so as to form pairs of mutually interconnected coil elements in the same way as the four coil elements 7 situated at the right. The number of turns of the second coil can thus be increased at will. If desired, more than two coils can thus be formed on a principal section 3 of the substrate. The first and second coils have the same winding direction in the embodiment shown. It is alternatively possible to impart a different winding direction to the second coil by making the conductor tracks of the coil elements 7' extend according to spirals whose winding direction opposes that of the spirals of the coil elements 7. The coils which are electrically isolated from one another in the described manner are magnetically coupled to one another after the folding of the substrate, so that they can serve as windings of a transformer. The second coil of the embodiment shown, comprising eight turns, may constitute the primary winding of the transformer and the first coil, comprising sixty turns, may constitute the secondary winding.

As has already been stated, the substrate comprises, in addition to the principal section 3, a number of lead-outs 5 which extend outside the principal section. Two lead-outs are provided at the area of each coil element 7, 7' in the embodiment shown. On both principal surfaces 1*a* and 1*b* of each lead-out 5 there is provided a further conductor track. A first further conductor track 23 is situated on one of the two principal surfaces and is directly electrically connected to the spiral-shaped conductor track of the coil element 7 situated on the same principal surface and adjoining the relevant lead-out 5. A second further conductor track 25 is situated on the opposite principal surface and is electrically isolated, by way of a non-metallized strip of the substrate, from the coil element 7 present on the same principal surface. The lead-outs 5 with the further conductor tracks 23 and 25 are remainders of a system of connections between the various conductor patterns present on a large sheet of foil which serves for electrolytic reinforcement of all conductors of the pattern during manufacture. Subsequent to this process step, in as far as they do not have a function, the lead-outs 5 can be cut off near the relevant principal section 3. The lead-outs 5 shown in the FIGS. 1A and 1B, however, have been cut off at some distance from the principal section 3 so that they can serve as terminals or branches of the coils formed from the coil elements 7. An electrical connection to one of the coil elements 7 can be established via a first further conductor track 23 connected to the relevant coil element. To this end, for example after the folding of the principal section 3, connection wires (not shown) can be soldered to the first further conductor tracks 23. Some first further conductor tracks 23 are situated on the first principal surface 1*a* and others on the second principal surface 1*b*. If desirable, a first further conductor track 23 can be connected to the second further conductor track 25, situated on the opposite principal surface, by means of a further interconnection 27 (denoted by a +). The connection to a connection wire need then no longer be established on the principal surface on which the first further conductor track 23 happens to be. In the embodiment shown two lead-outs 5 with further conductor tracks 23, 25 are connected to each pair of oppositely situated coil elements 7 and 7'. The two lead-outs 5 shown at the left in the FIGS. 1A and 1B serve for the connection of the primary winding formed by a coil consisting of the coil segments 7'. The other lead-outs 5 serve to connect the secondary winding which is formed by the eight remaining coil elements 7, and to form tappings from said secondary winding, so that a large number of different transformer output voltages can be realised.

In many cases it is desirable to couple the coils formed magnetically to a core of a soft-magnetic material. To this end, in the embodiment shown a central opening 29 is formed in each of the coil elements 7 and 7', near the inner end 9 of the spiral-shaped conductor track, the conductor track extending around said central opening. As is shown in FIG. 2, the central openings 9 together constitute a passage 31 in the folded principal section 3, the axis 21 extending through said passage. A limb 33 of a core 35 of a soft-magnetic material can be inserted through the passage 31 as shown in FIG. 3. FIG. 3 is a cross-sectional view of a transformer manufactured by means of the coils described with reference to the FIGS. 1 and 2. The core 35 may consist of, for example two E-shaped portions or of one E-shaped portion and one I-shaped portion. The central limb 33 of the E-shaped portion extends through the passage 31 as is known per se from EP-A-0 506 362. The core portions may be made of, for example ferrite.

A transformer having improved magnetic shielding can be achieved by constructing the core as a substantially closed box which encloses the folded principal section 3. An embodiment of such a transformer is shown in a cross-sectional view in FIG. 4 and in a perspective view in FIG. 5. In the present embodiment the core consists of a lower portion 37 in the form of an open box having walls 39 and a central limb 41. In the walls 39 there are provided openings 43 for the passage of the lead-outs 5. The openings 43 extend as far as the upper side of the walls 39. After the insertion of the folded principal section 3, the box is closed by means of a flat upper portion 45 which acts as a lid.

Generally speaking, an inductive device such as a transformer or coil will be intended for use in an electronic circuit, for example a switched power supply. In the case of the described inductive device of the invention, such an electronic circuit, or a part thereof, can be attractively provided on the same substrate as that on which the principal section 3 is accommodated. To this end, as appears from FIG. 6, the substrate comprises a further substrate section 47 which is connected to the principal section 3 and which carries third further conductor tracks 49, parts 49' of which serve to establish connections to further circuits, for example via an appropriate connector (not shown). Components 51 of the electronic circuit are provided on the third further conductor tracks 49. The third further conductor tracks 49 are also connected to at least two of the first further conductor tracks 23 on the lead-outs 5, either directly or, as described above, via the second further conductor tracks 25 and the further interconnections 27. In the embodiment shown in FIG. 6 the further substrate section 47 is situated at the left-hand side of the principal section 3. The first further conductor tracks 23 connected to the coil elements 7' situated near this side are prolonged in the direction of the further substrate section 47 in order to contact the third further conductor tracks 49. The second further conductor tracks 23, connected to the other coil elements 7, extend via a lead-out, formed as a widened portion of the principal section 3, to the left-hand side of the principal section where they also contact the third further conductor tracks 49. Such a configuration of the further conductor tracks 23, however, can also be adopted, in the absence of a further substrate section 47, when it is desirable to situate all connections of the inductive element to the same side of the principal section 3. After the folding of the principal section 3 and the mounting of, for example a core 37, 45 as shown in FIG. 5, the further substrate section 47 with the components 51 can be folded back so that it is situated on top of the upper portion 45. This results in a particularly compact circuit which can be readily handled.

We claim:

1. An inductive device, comprising a substrate in the form of a foil of an electrically insulating material having a principal section (3) and first and second principal surfaces (1*a*, 1*b*), on the first and second principal surfaces of the principal section there being provided first and second patterns of conductor tracks, respectively, each pattern comprising a series of coil elements (7) in such a manner that opposite each coil element of the first pattern there is situated a coil element of the second pattern, each of said coil elements comprising a conductor track which extends spirally between an inner end (9) and an outer end (11), at least some of the coil elements being electrically interconnected in a two-by-two fashion by means of a connection track (13) which extends between the outer ends of the spirals, the connection tracks on each of the two principal surfaces extending opposite parts of the other principal surface which are free from connection tracks, said principal section being folded along folding lines (19) which extend between every two successive coil elements, in such a manner that the coil elements are situated in mutually parallel planes, characterized in that the spirals along which the conductor tracks of oppositely situated coil elements (7) of the first and the second pattern extend have the same winding direction and that the inner ends (9) of the spiral-shaped conductor tracks of oppositely situated coil elements of the first and the second pattern are electrically interconnected by means of interconnections (15) which extend between the first and second principal surfaces (1*a*, 1*b*).

2. An inductive device as claimed in claim 1, wherein the first and the second pattern comprise at least two successive coil elements (7') which are electrically isolated from one another and which also occupy corresponding positions in the relevant pattern.

3. An inductive device as claimed in claim 1 wherein the substrate comprises a number of lead-outs (5) which extend outside the principal section (3), on at least one of the principal surfaces (1*a*, 1*b*) of each lead-out there being provided a first further conductor track (23) which is electrically connected to one of the spiral-shaped conductor tracks on the relevant principal surface.

4. An inductive device as claimed in claim 3, wherein on the oppositely situated principal surface (1*b*, 1*a*) of at least some of the lead-outs (5) there is provided a second further conductor track (25) which is electrically connected, by means of a further interconnection (27) which extends between the first and the second principal surface, to the first further conductor track (23) of the relevant lead-out.

5. An inductive device as claimed in claim 1, wherein each spiral-shaped conductor track extends around a central opening (29) which is formed in the principal section (3) and is situated near the inner end (9) of the relevant conductor track, all central openings in the folded principal section together constituting a passage (31), the device furthermore comprising a core (35) of a soft-magnetic material which comprises a limb (33) which extends through the passage.

6. An inductive device as claimed in claim 5, wherein the core is shaped as a substantially closed box (37, 45) which encloses the folded principal section (3).

7. An inductive device as claimed in claim 1, wherein the substrate comprises a further substrate section (47) which is connected to the principal section (3) and which supports third further conductor tracks (49) on which components (51) of an electronic circuit are mounted and which are connected to at least two of the first further conductor tracks (23).

* * * * *